US008689401B2

(12) United States Patent
Makarov et al.

(10) Patent No.: US 8,689,401 B2
(45) Date of Patent: Apr. 8, 2014

(54) VACUUM CLEANER DIRT CUP

(75) Inventors: Sergey V. Makarov, Solon, OH (US); Raymond P. Kawolics, Macedonia, OH (US); Christopher M. Charlton, Medina, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 13/398,298

(22) Filed: Feb. 16, 2012

(65) Prior Publication Data

US 2012/0210537 A1 Aug. 23, 2012

Related U.S. Application Data

(60) Provisional application No. 61/444,312, filed on Feb. 18, 2011.

(51) Int. Cl.
*A47L 9/16* (2006.01)

(52) U.S. Cl.
USPC ..... 15/353; 55/DIG. 3; 55/337; 55/345; 55/346; 55/349

(58) Field of Classification Search
USPC ..... 15/347, 353, 327.6, 327.7; 55/DIG. 3, 55/337, 345, 346, 349
See application file for complete search history.

(56) References Cited

U.S. PATENT DOCUMENTS

| | | | | |
|---|---|---|---|---|
| 4,643,748 A | | 2/1987 | Dyson | |
| 4,853,008 A | * | 8/1989 | Dyson | 55/345 |
| 5,062,870 A | | 11/1991 | Dyson | |
| 5,078,761 A | | 1/1992 | Dyson | |
| 5,090,976 A | * | 2/1992 | Dyson | 55/337 |
| 5,145,499 A | * | 9/1992 | Dyson | 55/337 |
| 6,171,356 B1 | * | 1/2001 | Twerdun | 55/337 |
| 6,818,036 B1 | | 11/2004 | Scaman | |
| 6,951,045 B2 | | 10/2005 | Thur et al. | |
| 7,065,826 B1 | * | 6/2006 | Arnold | 15/353 |

(Continued)

FOREIGN PATENT DOCUMENTS

EP 2471429 7/2012

OTHER PUBLICATIONS

International Search Report and Written Opinion for Application No. PCT/US2012/025422 dated Sep. 19, 2012 (8 pp.).

(Continued)

*Primary Examiner* — Mark Spisich
*Assistant Examiner* — Andrew A Horton
(74) *Attorney, Agent, or Firm* — Michael Best & Friedrich LLP

(57) ABSTRACT

A vacuum cleaner including a dirt cup assembly including a first stage cyclonic separator operable to at least partially separate debris from an airflow, a second stage cyclonic separator downstream from the first stage cyclonic separator and operable to at least partially separate the debris from the airflow, a container having a sidewall that at least partially defines the first stage cyclonic separator, and a shroud having a lower perforated portion located within the container, and an upper portion that surrounds and receives the second stage cyclonic separator. The upper portion is located outside of the first container such that the upper portion forms an outside wall of the dirt cup above the sidewall of the container. The shroud further includes an intermediate portion between the lower portion and the upper portion, and the intermediate portion is coupled to the sidewall of the first container.

20 Claims, 9 Drawing Sheets

(56) References Cited

U.S. PATENT DOCUMENTS

| | | | | |
|---|---|---|---|---|
| 7,329,295 | B2 | 2/2008 | Greene | |
| 7,419,522 | B2 * | 9/2008 | Arnold | 55/345 |
| 7,618,470 | B2 | 11/2009 | Eddington et al. | |
| 7,628,831 | B2 | 12/2009 | Gomiciaga-Pereda et al. | |
| 7,673,369 | B2 | 3/2010 | Gogel et al. | |
| 7,731,770 | B2 | 6/2010 | Strutt et al. | |
| 7,763,090 | B2 | 7/2010 | Gomiciaga-Pereda et al. | |
| 7,867,307 | B2 * | 1/2011 | Bates et al. | 55/343 |
| 7,874,040 | B2 | 1/2011 | Follows et al. | |
| 7,922,794 | B2 | 4/2011 | Morphey | |
| 2005/0091787 | A1 | 5/2005 | Bair et al. | |
| 2005/0125939 | A1 * | 6/2005 | Hansen et al. | 15/353 |
| 2006/0123590 | A1 * | 6/2006 | Fester et al. | 15/353 |
| 2007/0067944 | A1 | 3/2007 | Kitamura et al. | |
| 2007/0067945 | A1 * | 3/2007 | Kasper et al. | 15/353 |
| 2007/0163073 | A1 | 7/2007 | Sepke et al. | |
| 2007/0209144 | A1 * | 9/2007 | Fester et al. | 15/339 |
| 2008/0271284 | A1 * | 11/2008 | Wood et al. | 15/353 |
| 2009/0178237 | A1 * | 7/2009 | Proffitt et al. | 15/353 |
| 2009/0307864 | A1 | 12/2009 | Dyson | |
| 2009/0313958 | A1 | 12/2009 | Gomiciaga-Pereda et al. | |
| 2009/0313959 | A1 * | 12/2009 | Gomiciaga-Pereda et al. | 55/343 |
| 2010/0132319 | A1 | 6/2010 | Ashbee et al. | |
| 2010/0139033 | A1 | 6/2010 | Makarov et al. | |
| 2010/0269289 | A1 * | 10/2010 | Ruben | 15/353 |
| 2011/0023261 | A1 * | 2/2011 | Proffitt et al. | 15/347 |
| 2011/0225764 | A1 * | 9/2011 | Muhlenkamp et al. | 15/347 |

OTHER PUBLICATIONS

Examination Report from the United Kingdom Intellectual Property Office for application No. GB1300530.1 dated Jun. 11, 2013 (2 pages).

* cited by examiner

VACUUM CLEANER DIRT CUP

CROSS REFERENCE TO RELATED APPLICATIONS

This application claims priority to U.S. Provisional Patent Application No. 61/444,312, filed Feb. 18, 2011, the entire contents of which are hereby incorporated by reference herein.

BACKGROUND

The present invention relates to vacuum cleaners, and more particularly to dirt cups for use in vacuum cleaners.

A dirt cup is used to collect the dirt, dust, and other debris drawn in or vacuumed by a vacuum cleaner. When the dirt cup fills up with dirt, the user detaches the dirt cup from the vacuum cleaner and empties the collected dirt from the dirt cup. The dirt cup is then reattached to the vacuum cleaner. A vacuum cleaner that uses a dirt cup to collect dirt instead of a replaceable vacuum bag eliminates the need to purchase and replace vacuum bags as each bag fills up with dirt.

SUMMARY

In one embodiment, the invention provides a vacuum cleaner including a suction source operable to generate an airflow, a suction nozzle in fluid communication with the suction source and configured to remove debris from a surface using the airflow, and a dirt cup assembly including a first stage cyclonic separator operable to at least partially separate the debris from the airflow, a second stage cyclonic separator downstream from the first stage cyclonic separator and operable to at least partially separate the debris from the airflow, a container having a sidewall that at least partially defines the first stage cyclonic separator, and a shroud having a lower perforated portion located within the container, and an upper portion that surrounds and receives the second stage cyclonic separator. The upper portion is located outside of the first container such that the upper portion forms an outside wall of the dirt cup above the sidewall of the container. The shroud further includes an intermediate portion between the lower portion and the upper portion, and the intermediate portion is coupled to the sidewall of the first container.

In another embodiment, the invention provides a vacuum cleaner including a suction source operable to generate an airflow, a suction nozzle in fluid communication with the suction source and configured to remove debris from a surface using the airflow, and a dirt cup assembly including a first stage cyclonic separator operable to at least partially separate the debris from the airflow, a second stage cyclonic separator downstream from the first stage cyclonic separator and operable to at least partially separate the debris from the airflow, and a container having an upper end, a lower end, and a sidewall that extends between the upper end and the lower end to at least partially define the first stage cyclonic separator. The dirt cup assembly further includes a shroud having a lower perforated portion located within the container and an upper portion that surrounds and receives the second stage cyclonic separator. The upper portion is located outside of the first container. The shroud further includes an intermediate portion between the lower portion and the upper portion. The dirt cup assembly further includes a top lid attached to the upper portion of the shroud such that the top lid is spaced from the upper end of the container.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
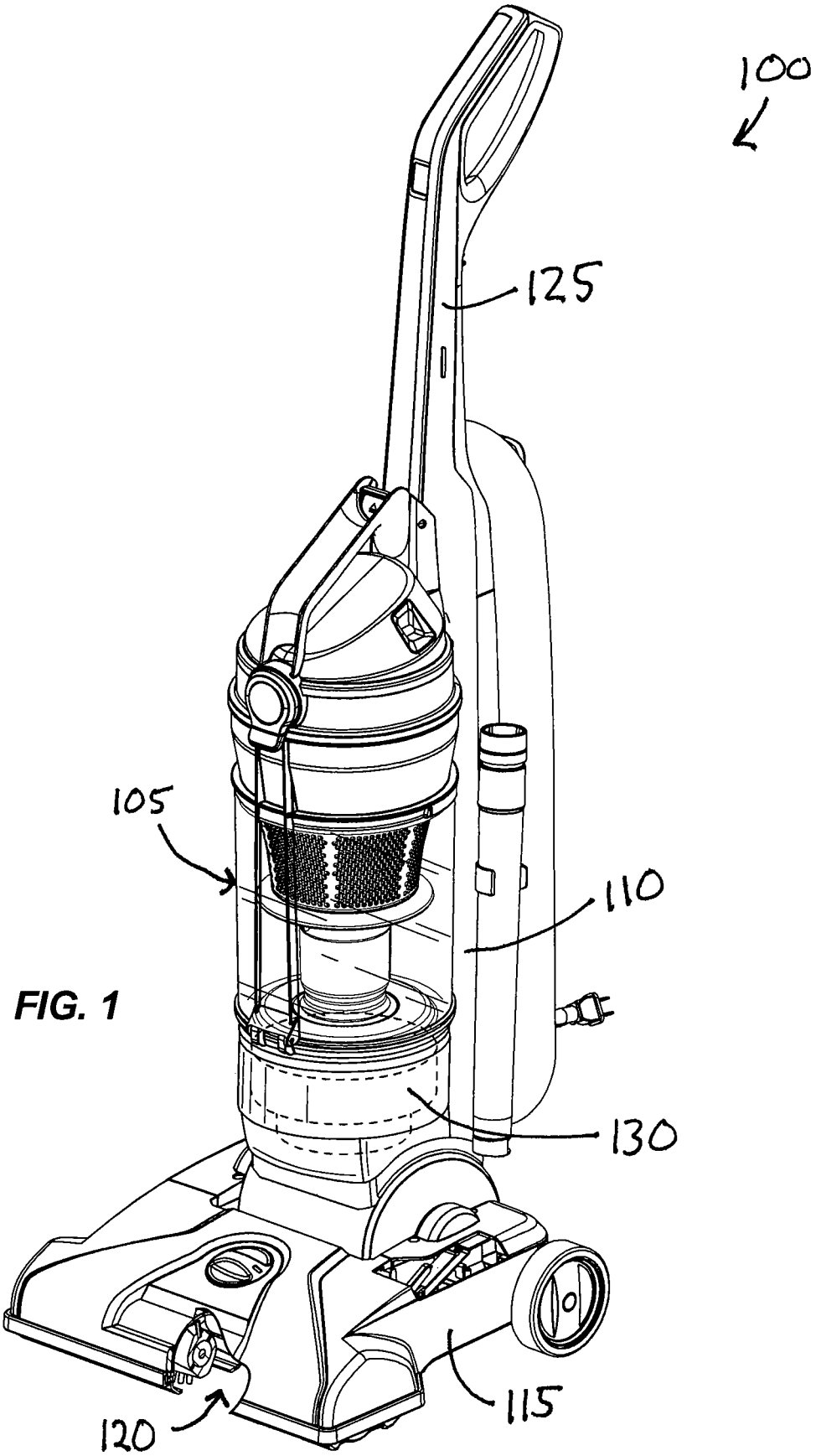
FIG. 1 is a perspective view of a vacuum cleaner according to an embodiment of the invention.

FIG. 1 illustrates a vacuum cleaner 100 that includes a dirt cup assembly 105 detachably secured to a body 110. The vacuum cleaner further includes a foot 115 including a suction nozzle 120, a handle 125, and a suction source 130. The foot 115 is pivotally connected to the body 110. The suction source 130 can be a motor and fan assembly or other suitable structure for creating a vacuum. The vacuum cleaner 100 as described above is an upright vacuum cleaner. Alternatively, the vacuum cleaner 100 can be of other types, including a canister vacuum cleaner, a central vacuum cleaner, a backpack style canister vacuum cleaner, and the like.

Figure 2:
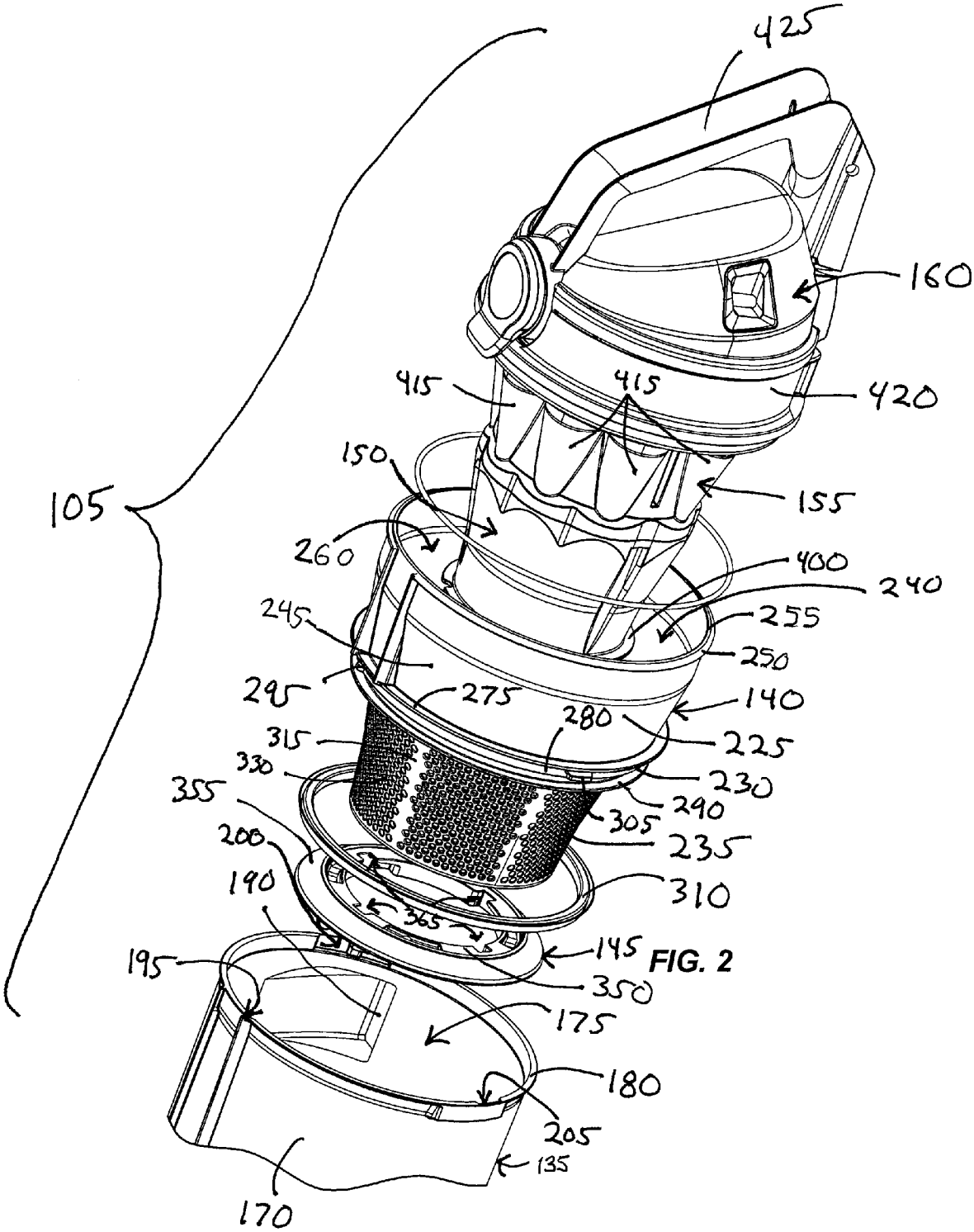
FIG. 2 is an exploded view of a dirt cup for use with the vacuum cleaner of FIG. 1.
Figure 3:
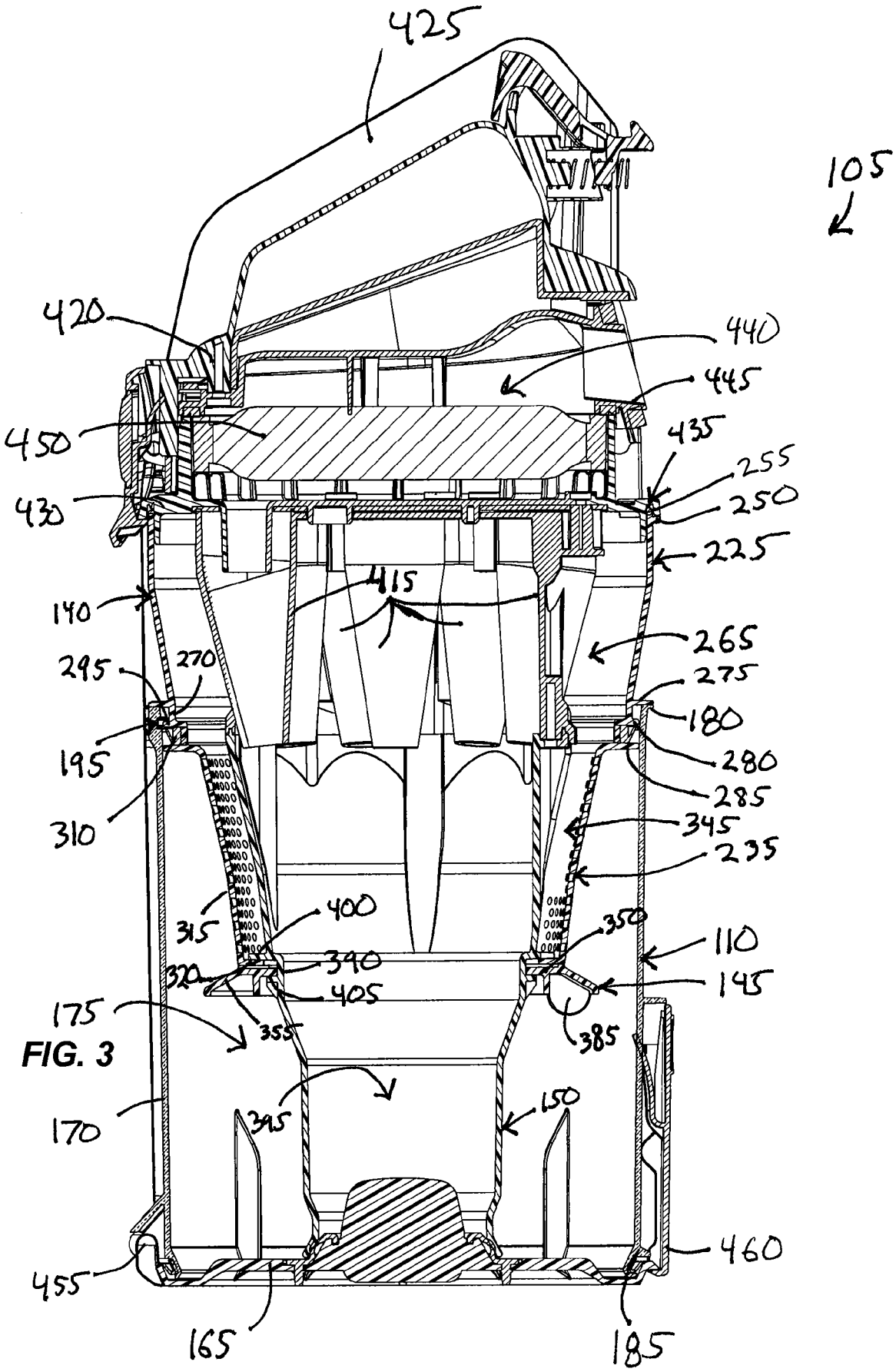
FIG. 3 is a cross-sectional view of the dirt cup of FIG. 2.
Figure 4:
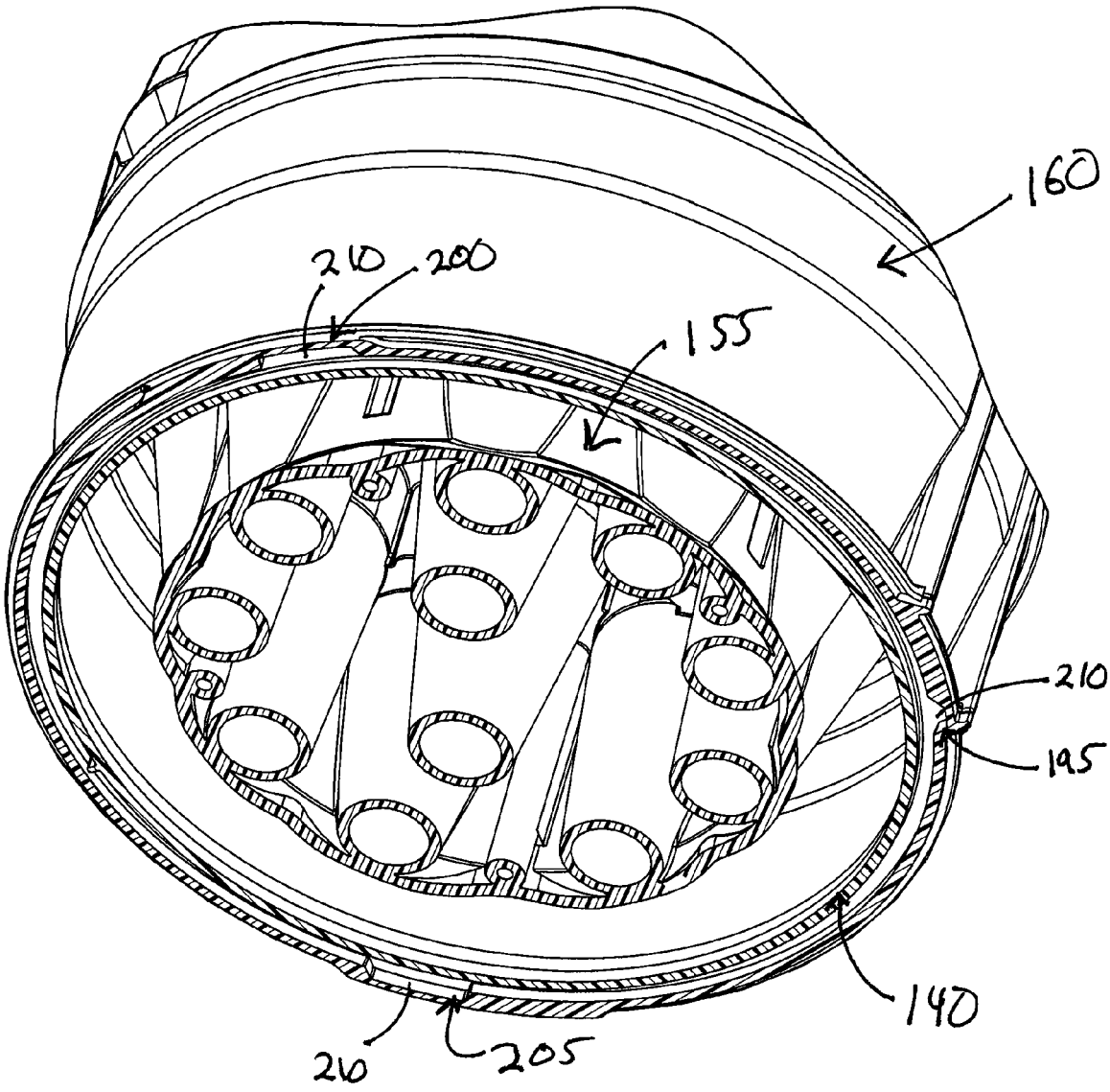
FIG. 4 is another cross-sectional view of the dirt cup of FIG. 2.
Figure 5:
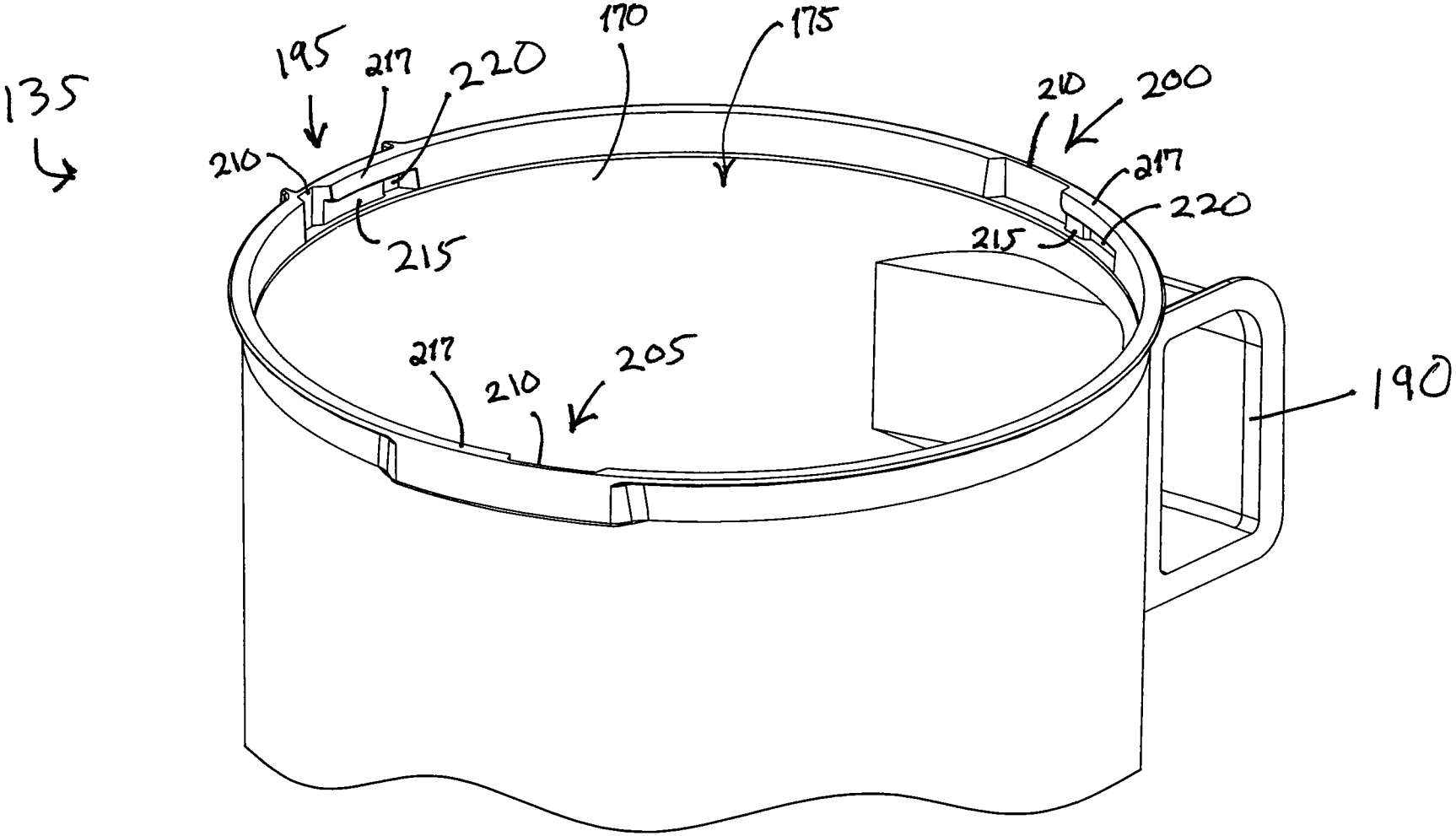
FIG. 5 is a perspective view of a portion of a container of the dirt cup of FIG. 2.

As shown in FIGS. 2-3, the dirt cup assembly 105 includes a container 135, a shroud 140, a skirt 145, a central support 150, a cyclone assembly 155, a top cover or lid 160, and a bottom cover or lid 165. The container 135 is a hollow cylinder and includes a sidewall 170, a central passageway 175, a top end 180, a bottom end 185, and a tangential air inlet 190. The sidewall 170 partially defines the central passageway 175, which extends from the top end 180 to the bottom end 185. Three locking cutouts 195, 200, and 205 are formed in sidewall 170 at the top end 180. Each cutout 195, 200, and 205 includes an opening 210 (FIG. 5) that extends longitudinally into the sidewall 170 and a slot 215 that extends into the sidewall 170 and along the curve of the sidewall 170. Each slot 215 defines a locking ledge 217 positioned adjacent to the opening 210. Each slot 215 communicates with the associated opening 210 and both the slot 215 and the opening 210 communicate with the central passageway 175. A locking detent 220 is positioned within the slot 215. The first cutout 195 is located on the front of the container 135 and the opening 210 of the first cutout 195 is smaller than the openings 210 of the second cutout 200 and the third cutout 205. In one embodiment, the container 135 is made of substantially transparent plastic. Alternatively, the container 135 can be shapes other than a cylinder. Alternatively, more or fewer cutouts 195, 200, and 205 can be formed in the container 135.

Figure 7:
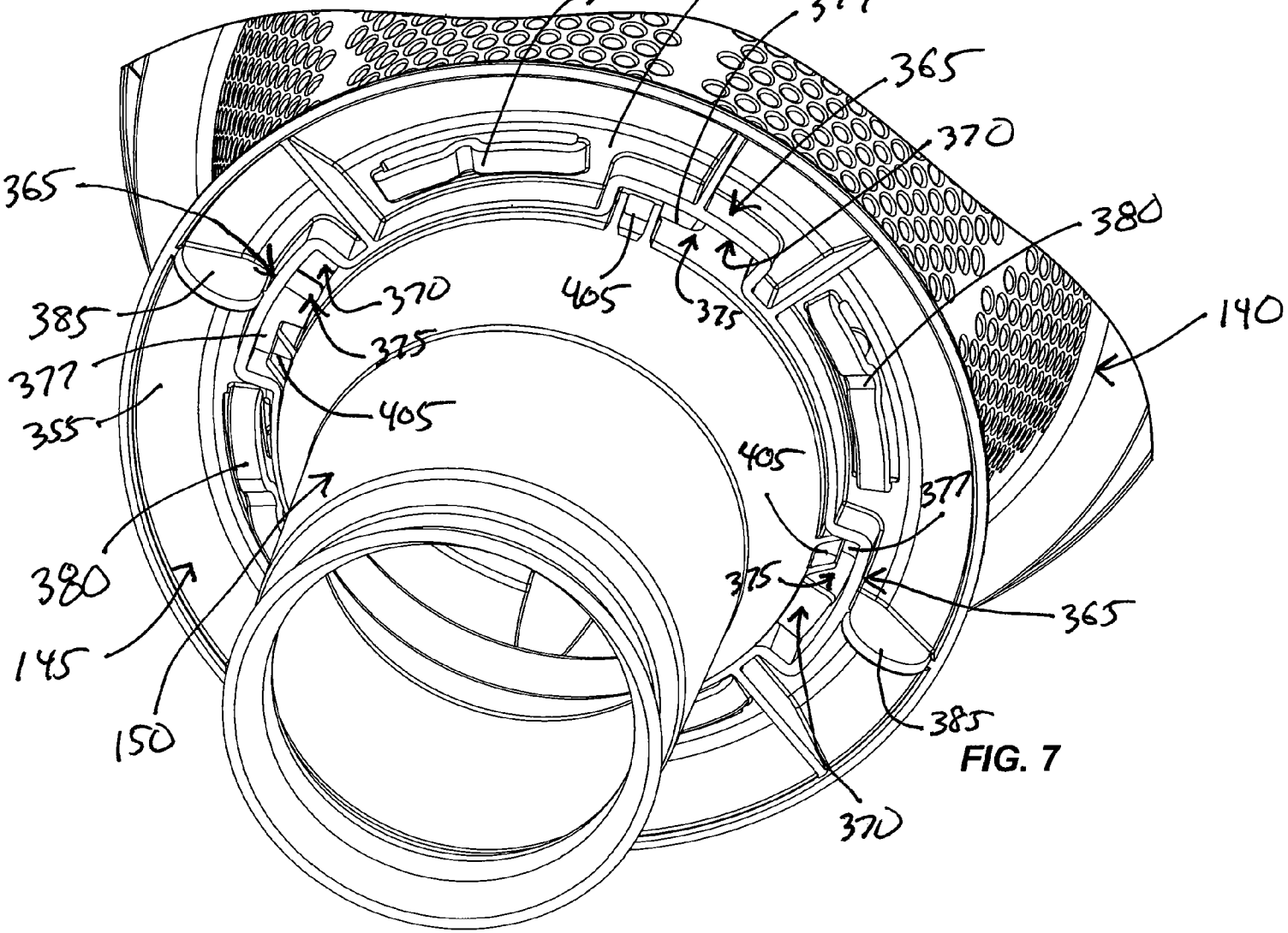
FIG. 7 is a perspective view of a central support, a skirt, and the shroud of the dirt cup of FIG. 2.
Figure 9:
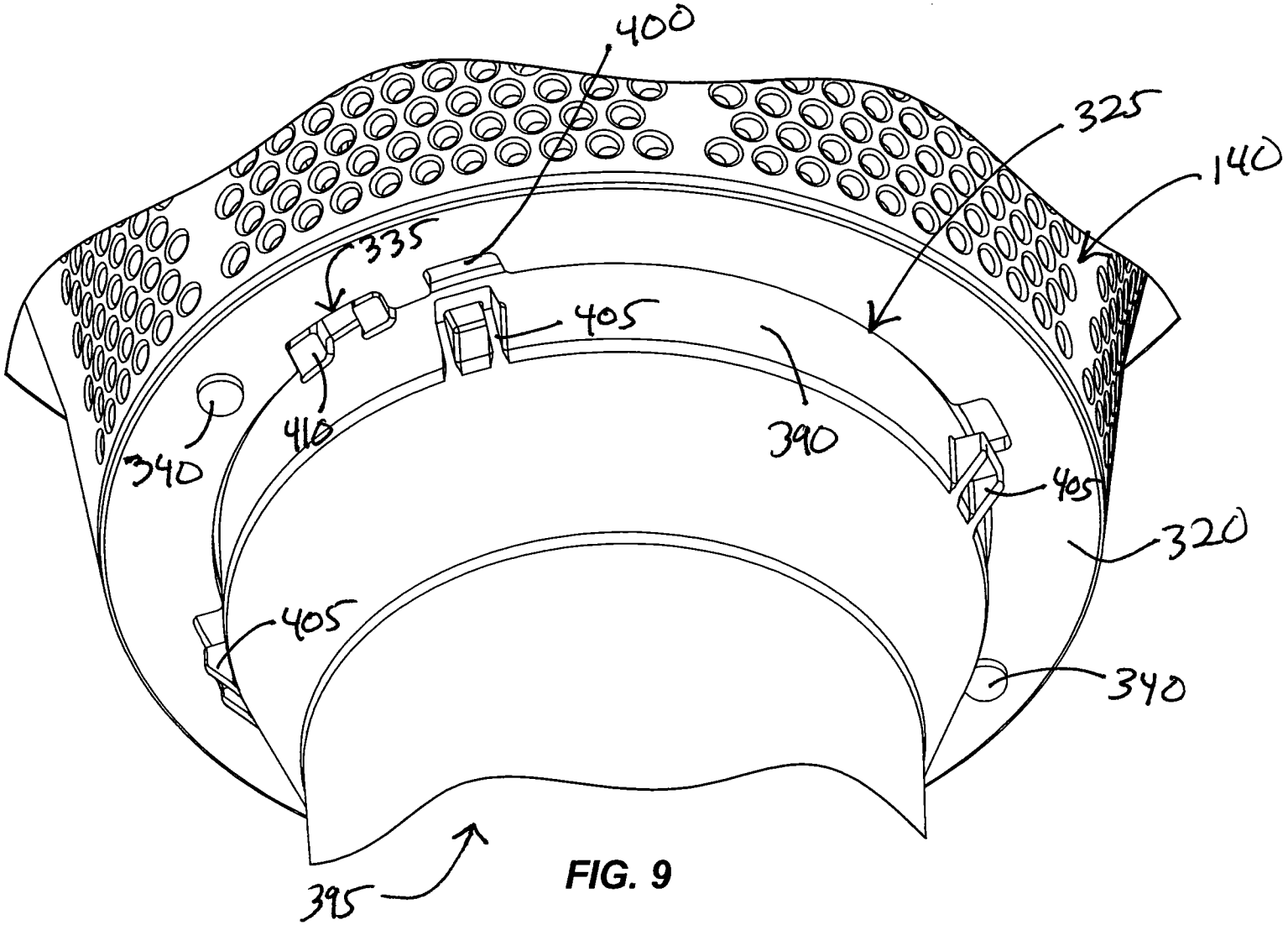
FIG. 9 is a perspective view of the central support and the shroud of the dirt cup of FIG. 2.

Referring to FIGS. 3, 7, and 9, the shroud 140 is a conduit that includes an upper portion 225, an intermediate portion 230, and a lower portion 235. A central passageway 240 passes through the shroud 140. The upper portion 225 includes a sidewall 245, a mounting flange 250, a mounting ring 255, and an upper opening 260. The mounting flange 250 extends radially outward from the sidewall 245 and the mounting ring 255 extends upwardly from the mounting flange 250. The upper opening 260 and central passageway 240 are sized and shaped so that the central support 150 and the cyclone assembly 155 can be inserted through the upper opening 260 into the central passageway 240, leaving a gap 265 between the sidewall 245 and the cyclone assembly 155.

Figure 6:
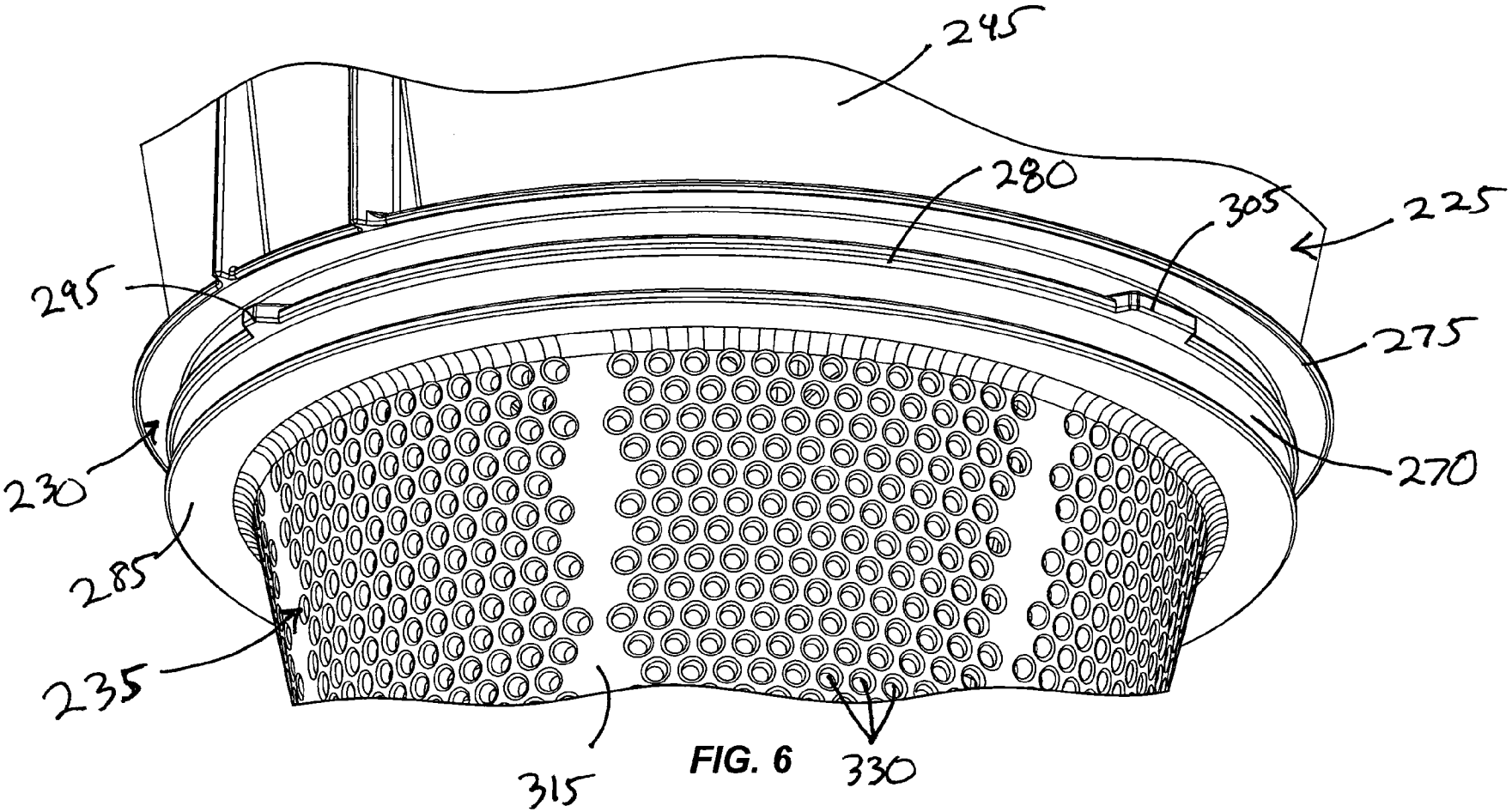
FIG. 6 is a perspective view of a portion of a shroud of the dirt cup of FIG. 2.

As shown in FIG. 6, the intermediate portion 230 of the shroud 140 is positioned between the upper portion 225 and the lower portion 235. The intermediate portion 230 includes a sidewall 270, an upper flange 275, an intermediate flange 280, and a lower flange 290. Each of the flanges 275, 280, and 290 extends radially outward from the sidewall 270. The intermediate flange 280 is positioned between the upper flange 275 and the lower flange 290. The intermediate flange 280 includes three locking tabs 295, 300, and 305. The first locking tab 295 is located on the front of the shroud 140 and is smaller than the second locking tab 300 and the third locking tab 305. A seal or gasket 310 is positioned in the space between the intermediate flange 280 and the lower flange 290. Alternatively, more or fewer locking tabs 295, 300, and 305 can be included on the intermediate flange 280.

As shown in FIGS. 2, 3, and 9 the lower portion 235 of the shroud 140 extends downwardly from the intermediate portion 230. The lower portion 235 includes a sidewall 315, a lower wall 320, and a lower opening 325. The sidewall 315 is substantially frusto-conical in shape and includes multiple holes, openings, or perforations 330 therethrough. The lower opening 325 is sized and shaped to receive the central support 150. At least one positioning cutout 335 is formed in the lower wall 320. Multiple circular positioning protrusions 340 extend from the bottom surface of the lower wall 320. The lower opening 325 and the central passageway 240 are sized and shaped so that the central support 150 can be inserted through the lower opening 325 into the central passageway 240, leaving a gap 345 between the sidewall 315 and the central support 150. In one embodiment, the shroud 140 is made of substantially transparent plastic.

Figure 8:
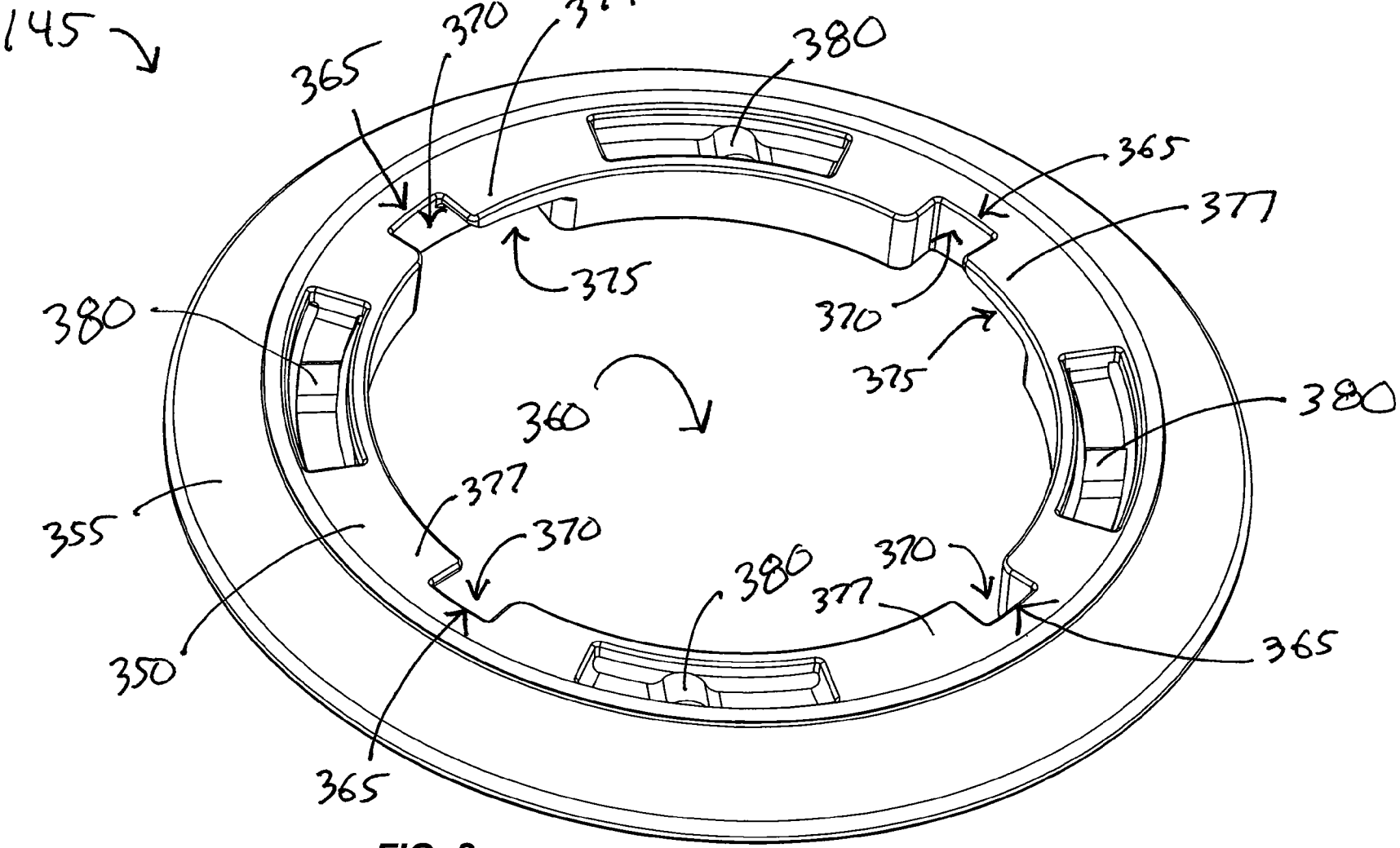
FIG. 8 is a perspective view of the skirt of the dirt cup of FIG. 2.

As shown in FIG. 8, the skirt 145 is ring-shaped and includes a central wall 350, a side wall 355, and a central passageway 360. Four locking cutouts 365 are formed in the central wall 350. Each cutout 365 includes an opening 370 that extends longitudinally into the central wall 350 and a slot 375 that extends into the central wall 350 and along the curve of the central wall 350. Each slot 375 defines a locking ledge 377 positioned adjacent to the opening 370. Each slot 375 communicates with the associated opening 370 and both the slot 375 and the opening 370 communicate with the central passageway 360. Four positioning springs 380 are formed in the central wall 350. The side wall 355 extends radially outward from the central wall 350 and is angled downwards from the top surface of the central wall 350 in the illustrated embodiment. A pair of gripping tabs 385 is provided on the bottom of the skirt 145 to allow a user to grip and twist the skirt 145. In one embodiment, the skirt 145 is made of substantially transparent plastic. Alternatively, more or fewer cutouts 365 can be formed in the skirt 145.

As shown in FIGS. 2, 3, 7, and 9, the central support 150 is a hollow tube that includes a sidewall 390, a central passageway 395, a flange 400, four locking tabs 405, and at least one positioning protrusion 410. The side wall 390 defines the central passageway 395, which extends the length of the central support 150. The flange 400 extends radially outward from the sidewall 390. The four locking tabs 405 extend outwardly from the sidewall 390 and are positioned below the flange 400. The positioning protrusion 410 also extends from the sidewall 390 and is positioned below the flange 400. In one embodiment, the central support 150 is made of substantially transparent plastic. Alternatively, more or fewer locking tabs 405 can be formed on the central support 150.

As shown in FIGS. 2 and 3, the cyclone assembly 155 includes a plurality of secondary cyclones 415 and is secured to the bottom of the top lid 160 and to the top of central support 150 to form a single component such that the cyclone assembly 155 is removable from the container 135 with the lid 160. Screws or other appropriate fasteners are used to secure the cyclone assembly 155 to the top lid 160 and the central support 150. Alternatively, the cyclone assembly 155 is not included and the vacuum cleaner 100 is a single stage cyclonic vacuum cleaner. Alternatively, the cyclone assembly includes a single cyclone 415.

As shown in FIGS. 2 and 3, the top lid 160 includes a body 420, a handle 425, and a bottom wall 430. A mounting slot 435 is formed in the bottom wall 430. The mounting slot 435 is ring-shaped. An air passage 440 extends from the bottom wall 430 to an air outlet 445. A filter 450 is positioned within the air passage 440. The filter 450 can be a foam filter, an electrostatic filter, a HEPA filter, or other appropriate type of filter.

As shown in FIG. 3, the bottom lid 165 is pivotally coupled to the container 135 by a hinge 455 located at or near the bottom end 185 of the container 135. The bottom lid 165 pivots about the hinge 455 between a closed position where the bottom lid 165 closes the bottom end 185 and a number of open positions. A lock or latch 460 secures the bottom lid 465 in the closed position.

To assemble the dirt cup assembly 105, the central support 150 and the cyclone assembly 155 are first inserted into the shroud 140 through the upper opening 260 and into the central passageway 240. The positioning cutout 335 in the lower wall 320 of the shroud 140 receives positioning protrusion 410 of the central support 150 to correctly orient the shroud 140 relative to the central support 150. The central support 150 passes through lower opening 325 of the shroud 140 so that the lower wall 320 of the shroud 140 contacts the flange 400 of the central support 150. The shroud 140 is attached to the top lid 160 so that the mounting slot 435 of the top lid 160 receives the mounting ring 255 of the shroud 140 and bottom wall 430 of the top lid 160 rests on the mounting flange 250 of the shroud 140. Aligning or guiding features on the top lid 160 and on the upper portion 225 of the shroud 140 can be included to help guide the mounting ring 255 into the mounting slot 435.

The shroud 140 is secured to the combination of the top lid 160, the central support 150, and the cyclone assembly 155 by the skirt 145. The central support 150 is inserted through the central opening 360 of the skirt 145. The opening 370 of each locking cutout 365 of the skirt 145 receives a corresponding locking tab 405 of the central support 150. The user then rotates or twists the skirt 145 in a first direction so that each of the locking tabs 405 is moved into the slot 375 of the locking cutout 365 in a twist-locking arrangement where the ledge 377 of each locking cutout 365 is positioned above the corresponding locking tab 405. The twist-lock between the skirt 145 and the central support 150 secures the shroud 140 between the skirt 145 and the top lid 160. Also, the positioning springs 380 of the skirt 145 is depressed by a corresponding positioning protrusion 340 of the shroud 140. The gripping tabs 385 provide locations for the user to grip while twisting the skirt 145 into the locked position. The shroud 140 can be unsecured from the combination of the top lid 160, the central support 150, and the cyclone assembly 155 by twisting the skirt 145 opposite the first direction so that the locking tabs 405 of the central support 150 pass through the openings 370 of the skirt 145.

The combination of the shroud 140, the central support 150, the cyclone assembly 155, and the top lid 160 is secured to the container 135 by a twist-lock between the shroud 140 and the container 135. The locking tabs 295, 300, and 305 of the shroud 140 are each inserted through the corresponding opening 210 of the locking cutouts 195, 200, and 205 of the container 135. The first locking tab 295 and the opening 210 of the first locking cutout 195 are sized differently than the other locking tabs 300 and 305 and the other openings 210 of the locking cutouts 200 and 205 to ensure that the shroud 140 is oriented properly with respect to the container 135. The user then rotates or twists either the shroud 140 or the container 135 in a first direction so that each of the locking tabs 295, 300, and 305 is moved into the slot 215 of the corresponding locking cutout 195, 200, and 205 in a twist-locking arrangement where the ledge 217 of each locking cutout 195, 200, and 205 is positioned above the corresponding locking tab 295, 300, and 305. Each locking tab 295, 300, and 305 is positioned in the detent 220 of the corresponding slot 215 in the locked position. The twist-lock between the shroud 140 and the container 135 secures the combination of the shroud 140, the central support 150, the cyclone assembly 155, and the top lid 160 to the container 135. In the locked position, the upper flange 275 of the shroud 140 is positioned on the top end 180 of the container 135. The gasket 310 provides a substantially air-tight seal between the shroud 140 and the container 135. The shroud 140 can be unsecured from the container 135 by twisting either the shroud 140 or the container 135 opposite the first direction so that the locking tabs 295, 300, and 305 of the shroud 140 pass through the openings 210 of the container 135.

As shown in FIG. 3, when assembled, the outermost wall or exterior surface of the dirt cup assembly 105 is formed in part by the shroud 140 and in part by the container 135. Therefore, only a single wall, the wall of the shroud 140, is between the exterior surface and the secondary cyclones 415 in a radial direction of the container 135. This single wall design saves material over double wall designs where the shroud is positioned entirely within the container. The transparent container 135, shroud 140, skirt 145 and central support 150 allow the user to see clogs or obstructions that may form within the dirt cup assembly 105. This allows the user to better service or troubleshoot problems related to clogs or obstructions.

During use of the vacuum cleaner 100, the suction source 130 generate an airflow that draws dirty air through the suction nozzle 120 to the tangential air inlet 190 in the container 135. The dirty air enters the dirt cup assembly 105 through the tangential air inlet 190 and is swirled in a cyclonic manner between the interior surface of the container 135 and the combination of the shroud 140, the skirt 145, and the central support 150, which defines a first cyclonic separator. This cyclonic action separates relatively large dirt particles from the dirty air. The partially cleaned air flows through the perforations 330 in the shroud 140, which can further filter the air, through the gaps 345 and 265 to the cyclone assembly 155. The partially cleaned air is swirled in a cyclonic manner within the cyclones 415, which form a second cyclonic stage downstream from the first cyclonic stage. This cyclonic action separates relatively small dirt particles from the partially cleaned air. The cleaned air passes from the cyclones 415 to the air passage 440 in the top lid 160. The cleaned air passes through the filter 450 and exits the top lid 160 through the air outlet 445, then to the suction source 130 where the air is exhausted from the vacuum cleaner 100.

To empty the dirt cup assembly 105, the dirt cup assembly 105 is released from the body 110. The dirt cup assembly 105 is then positioned above a trash can or other waste container and the bottom lid 165 is opened to empty the dirt collected in container 135 into the trash can. After the dirt cup assembly 105 is emptied, the bottom lid 165 is returned to the closed position and the dirt cup assembly 105 is secured to the body 110.

Various features of the invention are set forth in the following claims.

What is claimed is:

1. A vacuum cleaner comprising:

a suction source operable to generate an airflow;

a suction nozzle in fluid communication with the suction source and configured to remove debris from a surface using the airflow; and a dirt cup assembly including, a first stage cyclonic separator operable to at least partially separate the debris from the airflow, a second stage cyclonic separator downstream from the first stage cyclonic separator and operable to at least partially separate the debris from the airflow, wherein the second stage cyclonic separator includes a plurality of cyclonic separators arranged in parallel, a container having a sidewall that at least partially defines the first stage cyclonic separator, a shroud having a lower perforated portion located within the container, an upper portion that surrounds and receives the second stage cyclonic separator substantially in its entirety, the upper portion located outside of the container such that the upper portion forms an outside wall of the dirt cup above the sidewall of the container, and an intermediate portion between the lower portion and the upper portion coupled to the sidewall of the container, and a top lid attached to the upper portion of the shroud, wherein the second stage cyclonic separator is attached to the top lid such that the second stage cyclonic separator is removable from the shroud with the top lid.

2. The vacuum cleaner of claim 1, wherein the sidewall of the container is cylindrical.

3. The vacuum cleaner of claim 1, wherein the sidewall of the container includes a tangential air inlet of the first stage cyclonic separator.

4. The vacuum cleaner of claim 1, wherein the sidewall forms an outside wall of the dirt cup.

5. The vacuum cleaner of claim 1, wherein the container includes an upper end and a lower end, wherein the dirt cup assembly further includes a bottom lid coupled to the container to cover an opening at the lower end of the container.

6. The vacuum cleaner of claim 1, wherein the container further includes an upper end and a lower end, wherein the intermediate portion of the shroud is coupled to the sidewall of the container adjacent the upper end.

7. The vacuum cleaner of claim 6, wherein the intermediate portion of the shroud includes a locking tab, wherein the upper end of the container includes a locking cutout that receives the locking tab to couple the shroud and the container.

8. The vacuum cleaner of claim 1, wherein the upper portion of the shroud is substantially transparent.

9. The vacuum cleaner of claim 1, further comprising a foot including the suction nozzle; and a handle pivotally coupled to the foot, wherein the dirt cup assembly is removably coupled to the handle.

10. The vacuum cleaner of claim 1, further comprising a skirt located within the container adjacent the lower portion of the shroud, wherein the skirt includes an opening, wherein the dirt cup assembly further includes a support that extends through the opening of the skirt and defines a central passageway that receives the debris separated from the airflow by the second cyclonic stage, and wherein the skirt couples the shroud and the support such that the skirt, the shroud, and the support are removable from the container as a single component.

11. A vacuum cleaner comprising:

a suction source operable to generate an airflow;

a suction nozzle in fluid communication with the suction source and configured to remove debris from a surface using the airflow;

a dirt cup assembly including, a first stage cyclonic separator operable to at least partially separate the debris from the airflow, a second stage cyclonic separator downstream from the first stage cyclonic separator and operable to at least partially separate the debris from the airflow, wherein the second stage cyclonic separator includes a plurality of cyclonic separators arranged in parallel, a container having a sidewall that at least partially defines the first stage cyclonic separator, a shroud having a lower perforated portion located within the container, an upper portion that surrounds and receives the second stage cyclonic separator, wherein the upper portion is substantially cylindrical, the upper portion located outside of the container such that the upper portion forms an outside wall of the dirt cup above the sidewall of the container, and an intermediate portion between the lower portion and the upper portion coupled to the sidewall of the container, and a support that defines a central passageway that receives the debris separated from the airflow by the second cyclonic stage, and a skirt located within the container adjacent the lower portion of the shroud, wherein the skirt includes an opening, wherein the support extends through the opening of the skirt, and wherein the skirt couples the shroud and the support such that the skirt, the shroud, and the support are removable from the container as a single component.

12. The vacuum cleaner of claim 11, wherein the dirt cup assembly includes a top lid attached to the upper portion of the shroud, and wherein the second stage cyclonic separator is attached to the top lid such that the second stage cyclonic separator is removable from the shroud with the top lid.

13. A vacuum cleaner comprising:

a suction source operable to generate an airflow;

a suction nozzle in fluid communication with the suction source and configured to remove debris from a surface using the airflow; and a dirt cup assembly including, a first stage cyclonic separator operable to at least partially separate the debris from the airflow, a second stage cyclonic separator downstream from the first stage cyclonic separator and operable to at least partially separate the debris from the airflow, wherein the second stage cyclonic separator includes a plurality of cyclonic separators arranged in parallel, a container having an upper end, a lower end, a sidewall that extends between the upper end and the lower end to at least partially define the first stage cyclonic separator, a shroud having a lower perforated portion located within the container, an upper portion that surrounds and receives the second stage cyclonic separator, the upper portion located outside of the container, and an intermediate portion between the lower portion and the upper portion, wherein the upper portion defines a flange, wherein the shroud is a single, unitary component, and a top lid attached to the flange such that the top lid is spaced from the upper end of the container.

14. The vacuum cleaner of claim 13, wherein the second stage cyclonic separator is attached to the top lid such that the second stage cyclonic separator is removable from the shroud with the top lid.

15. The vacuum cleaner of claim 13, further comprising a skirt located within the container adjacent the lower portion of the shroud.

16. The vacuum cleaner of claim 15, wherein the skirt includes an opening, and wherein the dirt cup assembly further includes a support that extends through the opening of the skirt and defines a central passageway that receives the debris separated from the airflow by the second cyclonic stage.

17. The vacuum cleaner of claim 16, wherein the skirt couples the shroud and the support such that the skirt, the shroud, and the support are removable from the container as a single component.

18. The vacuum cleaner of claim 17, wherein the skirt is rotatable with respect to the support to couple the shroud, the support, and the skirt.

19. The vacuum cleaner of claim 13, wherein the upper portion of the shroud forms an outside wall of the dirt cup above the upper end of the container.

20. The vacuum cleaner of claim 19, wherein the intermediate portion of the shroud is attached to the sidewall of the container adjacent the upper end of the container.

* * * * *